US007674130B2

(12) United States Patent
Giefers

(10) Patent No.: US 7,674,130 B2
(45) Date of Patent: Mar. 9, 2010

(54) ELECTRIC CONNECTOR FOR ROUTING A LINE THROUGH A HOUSING WALL

(75) Inventor: Stefan Giefers, Detmold (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 435 days.

(21) Appl. No.: 11/573,436

(22) PCT Filed: Nov. 8, 2005

(86) PCT No.: PCT/EP2005/011934

§ 371 (c)(1),
(2), (4) Date: Feb. 8, 2007

(87) PCT Pub. No.: WO2006/050906

PCT Pub. Date: May 18, 2006

(65) Prior Publication Data

US 2009/0098768 A1 Apr. 16, 2009

(30) Foreign Application Priority Data

Nov. 9, 2004 (EP) ..... 04026504
Apr. 25, 2005 (EP) ..... 05009041

(51) Int. Cl.
*H01R 13/73* (2006.01)

(52) U.S. Cl. ..... 439/557; 439/552

(58) Field of Classification Search ..... 439/552–557, 439/352, 248, 345, 350, 353–354, 357–358, 439/373; 174/153 R See application file for complete search history.

(56) References Cited

U.S. PATENT DOCUMENTS 3,432,802 A * 3/1969 Ritchie ..... 439/465
4,453,195 A * 6/1984 Sauer et al. ..... 361/156
4,461,938 A * 7/1984 Sorenson ..... 200/296
4,947,010 A * 8/1990 Heydner et al. ..... 200/296
5,279,507 A 1/1994 Kameyama
5,621,328 A 4/1997 Yamanashi
5,800,208 A 9/1998 Ishizuka et al.
5,830,008 A * 11/1998 Broschard, III ..... 439/557

(Continued)

FOREIGN PATENT DOCUMENTS

DE 19801260 A1 7/1999
DE 299 07 005 U1 8/1999

OTHER PUBLICATIONS

International Search Report in English for PCT/EP2005/011934.

*Primary Examiner*—Michael C Zarroli
(74) *Attorney, Agent, or Firm*—David S. Safran; Roberts Mlotkowski Safran & Cole, P.C.

(57) ABSTRACT

An electric connector for passing a line through a housing wall has a rectangular housing made of an insulating material, at least one connection element and a securing element used to secure the connector to the rectangular wall opening of the housing wall. The securing element includes at least one fixing element and an elastic clamping element which is arranged in an essentially perpendicular manner in relation to the fixing element, such that the clamping element interacts against an inner edge of the narrow side of the wall opening when the connector is in the mounted state.

21 Claims, 3 Drawing Sheets

U.S. PATENT DOCUMENTS 6,547,591 B2 4/2003 Okabe et al.
6,648,681 B2 * 11/2003 Ushiro et al. ..... 439/557
6,659,796 B1 * 12/2003 Waddell et al. ..... 439/557
6,709,286 B1 3/2004 Korsunsky et al.
2006/0194473 A1 8/2006 Lange

* cited by examiner

ELECTRIC CONNECTOR FOR ROUTING A LINE THROUGH A HOUSING WALL

BACKGROUND OF THE INVENTION

1. Field of the Invention

The invention relates to an electrical terminal for routing a line through a housing wall, with a rectangular terminal housing of insulating material, with at least one connecting element and with a mounting element for fixing the terminal in a rectangular wall opening of the housing wall, the mounting element having at least one fixing element. In addition, the invention relates to a mounting element for fixing an electrical terminal in the wall opening of a housing wall, with at least one fixing element.

2. Description of Related Art

Electrical terminals or electrical connectors for routing a line through a housing wall are often also called bushing terminals or bushing connectors. Both one-part and also two-part bushing terminals are known. In the two-part bushing terminals one part of the terminal is mounted in the housing wall opening, while the other part is electrically and mechanically connected to the part which has been mounted in the wall opening—the plug part.

Electrical connectors are used in electrical terminals together with the corresponding attachment plugs for connecting an electrical conductor to the electronics of a device. Depending on the embodiment, the electrical connector can be made as a socket part or as a plug part. Since the electrical connector is electrically and mechanically connected to the electronics or to the housing of the device, while an electrical line is connected to the corresponding attachment plug, a stationary electrical connector is often called the base body or base housing. Various embodiments of electrical connectors or the corresponding attachment plugs, i.e. different base bodies and different plug parts, are known for example from the Phoenix Contact Catalog "COMBICON 2002", pages 196 to 203.

In this case, the different plug parts differ especially by the different connection possibilities for the conductors to be connected. Thus, plug parts with screw, spring force, crimp and insulation piercing terminals are known. Conversely, the connectors and the base bodies differ especially in whether the contact element as the contact leg has a pin contact or a socket contact, the version with the pin contact constituting the standard version. If the electrical connector has a pin contact as the contact leg, the connector is made as a socket part into which the attachment plug which has a socket contact is inserted.

For fixing in the wall opening in the housing, it is immaterial whether an electrical terminal or an electrical connector is involved. For this reason, within the framework of the invention an electrical terminal is always addressed below, this also to be understood as an electrical connector.

Various possibilities are known for attaching the electrical terminals in the wall opening of the housing wall. German Patent DE 36 13 681 C1 discloses for example a two-part terminal, the two parts of the electrical terminal having catch elements which correspond to one another and which lock with one another and prevent separation of the two terminal parts opposite the joining direction when the two terminal parts are inserted into one another. Both parts of the terminal are inserted in the direction which is the opposite at the time through the opening in the housing wall so that the housing wall is clamped between the parts of the terminal.

A comparable principle is followed by the teaching of German Patent DE 198 01 260 C2 in which the one-part terminal housing is routed through the wall opening. The insertion process is limited by a stop on the terminal housing. Then a catch clip is slipped onto the part of the electrical terminal routed through the wall opening and locks with the two opposing sides of the housing of the terminal so that the housing wall is fixed between the stop on one side and the catch clip on the other side.

The disadvantage in the described attachment possibilities under certain circumstances can be major mounting problems which arise solely by the housing wall having to be accessible on both sides, therefore from the inside of the housing and also the outside of the housing. Furthermore, for only poorly accessible mounting sites there is the danger that one component of the terminals which is made in several parts can be lost.

German Utility Model DE 202 00 974 U1 discloses a one-piece terminal which is inserted through the wall opening of the housing, when the terminal is inserted through the wall opening spring catches provided on two opposing sides of the terminal each being forced back by the inside edge of the wall opening, the spring catches springing back after passing through the wall and thus locking with the corresponding inside edge of the wall opening. For final fixing of the terminal in the wall opening, the spring catches must be prevented from spring back again by a blocking slide which can only be operated from inside the housing, while the terminal must be inserted first from the outside into the wall opening so that access to the two sides of the housing wall is also necessary here.

German Patent Application DE 103 15 661 A1 underlying the invention discloses an electrical terminal which is inserted as a unit into the wall opening of the housing wall up to a stop, whereupon locking elements can be pressed by an actuating element against two opposing inside edges of the wall opening, so that the electrical terminal is fixed securely in the wall opening in the direction of action of the locking elements.

However, the disadvantage here can also be that locking takes place only with two opposing edges of the wall opening. This results in that in the presence of a tolerance between the electrical terminal and the wall opening, movement of the terminal in the wall opening cannot be reliably prevented.

SUMMARY OF THE INVENTION

The teaching of this invention therefore underlies the object of making available an electrical terminal with improved properties for mounting in the opening of the housing wall.

The electrical terminal in accordance with the invention in which this object is achieved is first of all essentially characterized in that the mounting element additionally has an elastic clamping element which is located essentially perpendicular to the fixing element such that the clamping element in the mounted state of the terminal acts against the inside edge of the narrow side of the wall opening.

The electrical terminal in accordance with the invention is advantageous in many respects. The elastic clamping element makes it possible to close tolerances between the inside edge of the narrow side of the wall opening and the terminal housing, the comparable play between the terminal and the inside edge of the wall opening being determined by the maximum spring path of the elastic clamping element. In addition to this purely geometrical compensation of play, the elastic clamping element moreover also causes fixing of the terminal in the wall opening of the housing wall in the direction of this inside edge of the wall opening. At the same time the elastic clamping element also fixes the terminal in the wall opening in the joining direction and in the direction opposite the joining direction, i.e. perpendicular to the actual main clamping direction.

The terminal in accordance with the invention can be further improved with respect to its fixing in the opening of the housing wall by the elastic clamping element having an arched or oblique clamping surface and the clamping surface for its part having several ribs which run parallel to one another. In the installed state of the terminal then at least one rib forms teeth depending on the thickness of the housing wall with the inside edge of the wall opening. In this way the terminal can be fixed in the wall opening of housings with different wall thickness. The extension of the arched or oblique clamping surface in the joining direction of the terminal defines the maximum thickness of the housing wall with which the elastic clamping element can interact so that the desired catch action with the inside edge of the wall opening is achieved.

The terminal in accordance with the invention can be developed especially advantageously with respect to its locking in the opening of the housing wall by the mounting element having an actuating wedge which is located with a swivelling or pivoting capacity on the mounting element such that it can be pivoted into the position in which the elastic clamping element in the mounted state of the terminal is pressed by the actuating wedge against the corresponding inside edge of the wall opening. The actuating wedge can be fixed in this position so that the location of the elastic clamping element in the installed state of the terminal can also be permanently maintained.

When the actuating wedge is swivelled into its mounting position the actuating wedge penetrates between the elastic clamping element and the terminal housing so that the elastic clamping element is moved away from the terminal housing toward the opposing inside edge of the housing wall by the wedge action applied by the actuating wedge. The elastic clamping element is thus pressed against the spring force of the actuating wedge which arises by the deflection of the clamping element to the outside against the inside edge of the wall opening. In the described advantageous development of the terminal in accordance with the invention, the clamping element therefore comparatively closely adjoins the terminal housing and is deflected only by the action of the force of the actuating wedge.

So that this deflection is permanently maintained in the mounted state, the actuating wedge must remain in the described position. This is advantageously achieved in that teeth are formed on the surface of the actuating wedge and on the side of the fixing element facing the surface of the actuating wedge opposing teeth which correspond thereto are formed. This configuration of the actuating wedge thus provides for reliable fixing of the terminal in the opening of the housing wall by the elastic spring element being pressed against the inside edge of the wall opening and being held at the same time in its installation position.

The aforementioned object is furthermore achieved with a mounting element for fixing the electrical terminal in the opening of the housing wall, with at least one fixing element which is characterized in that there is an elastic clamping element which is located essentially perpendicular to the fixing element, the mounting element having an essentially U-shaped base body, with a U-back and two U-legs and a catch tongue which runs essentially parallel to the base body. In this connection the ends of the two U-legs are each made as a fixing element and the elastic clamping element is formed by the free end of the catch tongue. The spring force of the clamping element is pointed essentially perpendicular to the lengthwise direction of the fixing element.

The mounting element in accordance with the invention can be made especially advantageously when the catch tongue for its part is attached with its base area in the region of the U-back of the mounting element. The advantage of the mounting element in accordance with the invention lies in its simple geometry which is especially unproblematic in production as well as in further application, for example when such a mounting element is attached to an electrical terminal.

A further improvement of the mounting element can be achieved in that the free end of the catch tongue has an arched or oblique clamping surface which points to the outside and several ribs which run parallel to one another are formed on the clamping surface. This improved configuration enables the mounting element to interact reliably with the inside edge of the opening in the housing wall and the electrical terminal to be reliably fixed in the wall opening.

According to another embodiment of the mounting element, an actuating wedge is arranged to be able to pivot on the free end of the U-leg. The actuating wedge can be swivelled into a position such that it presses the elastic clamping element in the mounted state of the terminal against the corresponding inside edge and thus provides for reliable fixing of the terminal in the wall opening. Thus the elastic clamping element can be deflected by the actuating wedge against its spring force, by which the terminal in the mounted state is fixed in the wall opening.

In particular, there are various possibilities for embodying and developing the terminal in accordance with the invention and the mounting element in accordance with the invention. In this respect reference is made to the claims and to the description of preferred embodiments in conjunction with the drawings.

DETAILED DESCRIPTION OF THE INVENTION

Figure 1:
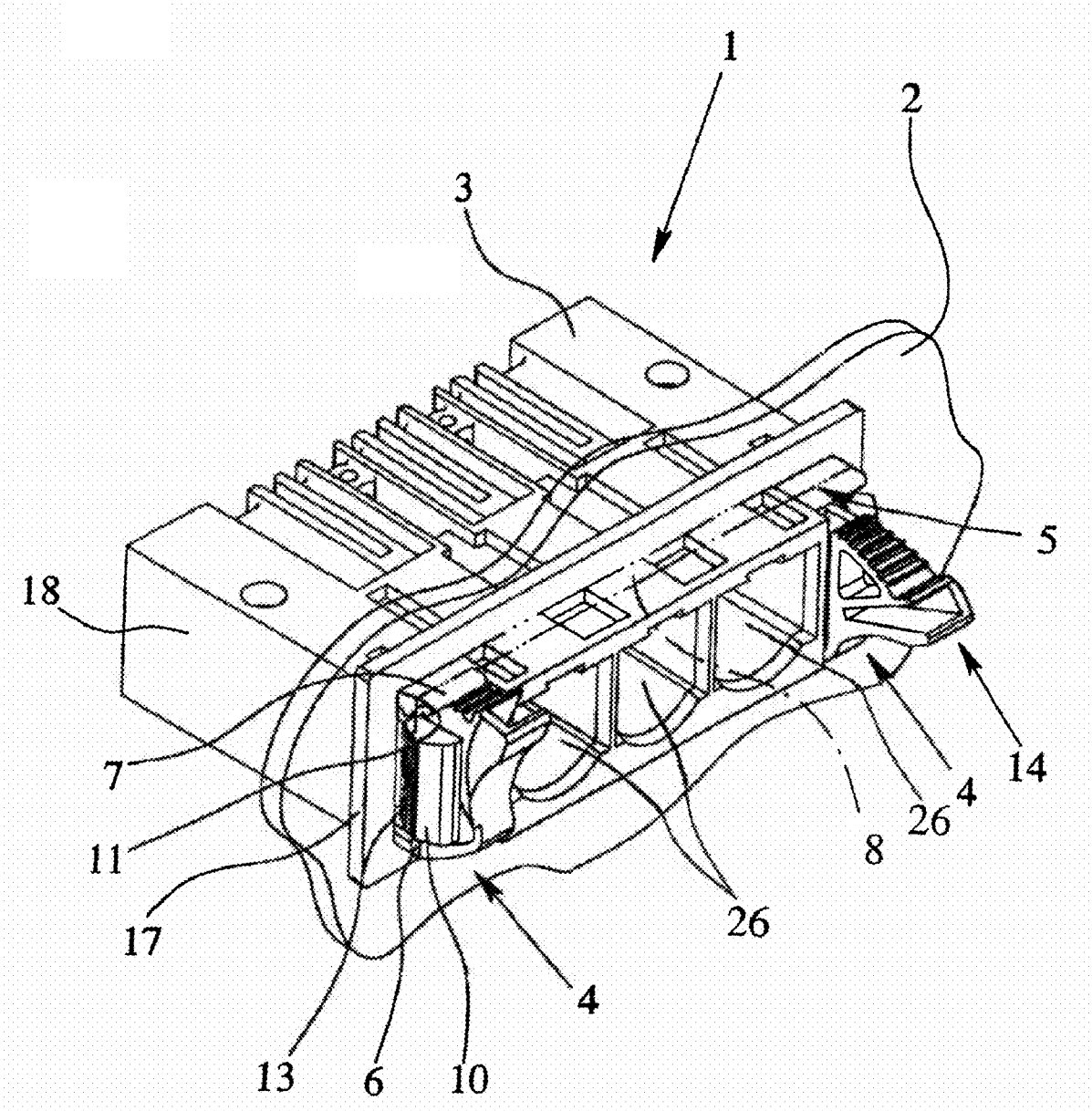
FIG. 1 shows a perspective representation of one preferred embodiment of the electrical terminal in accordance with the invention and the use of a mounting element in accordance with the invention in an electrical terminal.

FIG. 1 shows an electrical terminal 1 for routing a line through the housing wall 2. The terminal 1 has a rectangular terminal housing 3 of insulating material with—in this specific embodiment — three connecting elements 26, the connecting elements 26 adjoining and on two ends being bordered by one mounting element 4 at a time for fixing the terminal 1 in a likewise rectangular wall opening 5. The number of connecting elements of the terminal 1 is completely irrelevant to the teaching underlying the electrical terminal in accordance with the invention; one preferred embodiment has fewer, but also more terminal elements could have been shown equally well. In particular, several disk-shaped terminals 1 with one terminal element each can also be joined into a terminal block, then the terminal block having altogether one mounting element 4 each on two sides.

Figure 3:
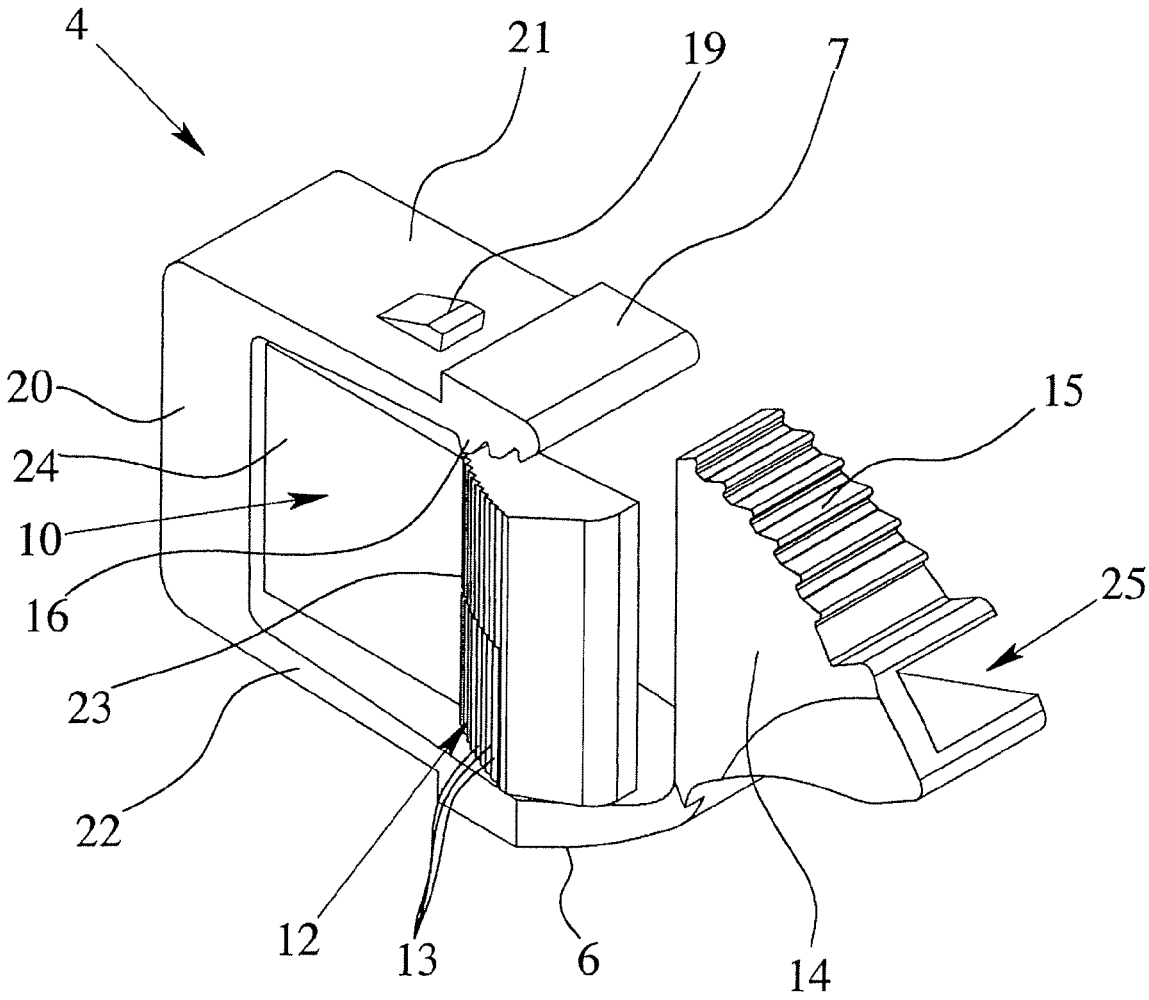
FIG. 3 shows one preferred embodiment of a mounting element in accordance with the invention.

The mounting element 4 which is shown isolated in FIG. 3 has two fixing elements 6, 7 which in the mounted state of the terminal 1 each adjoin one inside edge 8, 9 of the wall opening 5 or press lightly against the inside edges 8, 9 and thus cause the electrical terminal 1 to be pre-fixed in the wall opening 5. As seen in the Figures, the fixing elements 6, 7 are formed as ledges. The two fixing elements 6, 7 are arranged opposite one another so that they also interact with the two opposing inside edges 8, 9 of the wall opening 5. In the embodiment the inside edges 8, 9 are the lengthwise sides of the wall opening 5. In the prior art, especially in the terminal known from DE 103 15 661 A1, the terminal 1 is fixed in the wall opening 5 solely via locking elements which act on the lengthwise sides of the wall opening 5.

Figure 2:
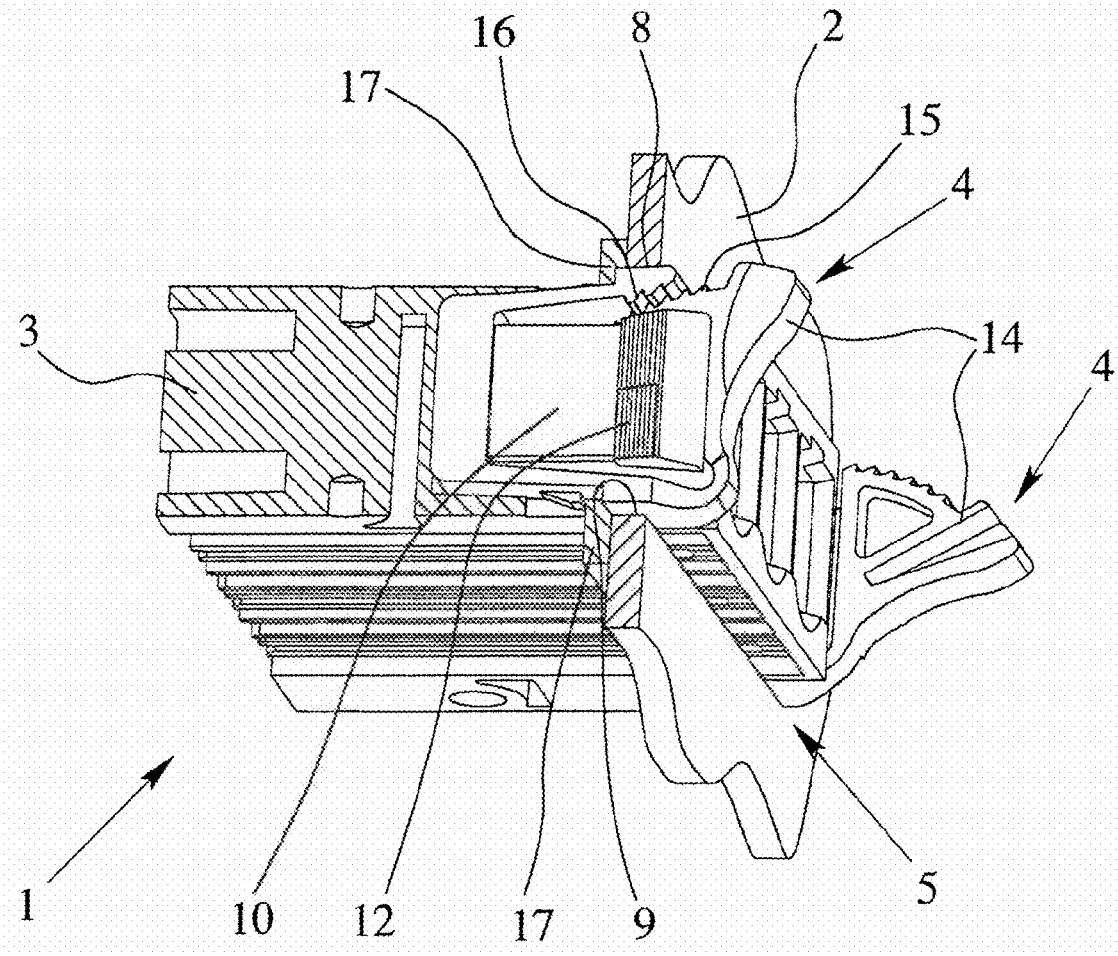
FIG. 2 shows another perspective of the electrical terminal in accordance with the invention as shown in FIG. 1

In contrast thereto, the terminal 1 which is shown in FIGS. 1 and 2 has an elastic clamping element 10 which in the mounted state of the terminal 1 presses against another inside edge 11—the narrow side—of the wall opening 5. The inside edge 11 runs perpendicular to the two inside edges 8, 9. Because the mounting element 4 of the terminal 1 acts not only in the known manner against the two inside edges 8, 9 of the wall opening 5, but especially with the elastic clamping element 10 against the inside edge 11 of the narrow side, fixing of the terminal 1 in the direction to this inside edge 11 is ensured, i.e. in the horizontal direction. The elastic clamping element 10 of the mounting element 4 therefore also enables an electrical terminal 1 to be mounted reliably in such a wall opening 5 which would normally surround the electrical terminal 1 only with a certain play and the gaps which have formed.

In the preferred embodiment in FIGS. 1 and 2, the elastic clamping element 10 of the electrical terminal 1 has an oblique, slightly arched clamping surface 12, with several ribs 13 which run parallel to one another in the clamping surface 12. The ribs 13 which run parallel to one another are arranged such that at least one rib 13 in the mounted state of the terminal 1 forms teeth with the inside edge 11 of the wall opening 5. Which of the ribs 13 running parallel to one another interacts with the inside edge 11 depends on the thickness of the housing wall 2 and also on the distance by which the elastic clamping element 10 must be deflected until it interacts with the inside edge 11 of the wall opening 5. It is apparent from FIGS. 1 and 2 and from the aforementioned that the electrical terminal 1 can be fixed in the wall opening 5 of the housing walls 2 which have different wall thicknesses. How dramatically the wall thickness of the housing wall 2 can vary depends structurally essentially on the extension of the clamping surface 12 in the joining direction of the electrical terminal 1.

In the illustrated embodiment of the electrical terminal the mounting element 4 has an actuating wedge 14 which is located pivotally on the mounting element 4. The actuating wedge 14 in FIGS. 1 and 2, each in the forward position, is pivoted into a mounting position such that it presses the fixing elements 6, 7 and especially the elastic clamping element 10 against the corresponding inside edge 8, 9 and 11 of the wall opening 5. So that the fixing of the terminal 1 caused in this way in the wall opening 5 is maintained permanently, the actuating wedge 14 is fixed in its mounting position.

The fixing of the actuating wedge 14 in the embodiment is implemented in that on the surface of the actuating wedge 14 teeth 15 are formed. These teeth 15 interact with the corresponding opposing teeth 16 which are made on the side of the first fixing element 6 facing the surface of the actuating wedge 14. The shaping of the actuating wedge 14 shown in the figures has a double action when the actuating wedge 14 is pivoted into its mounting position. The first, known action consists in that the fixing elements 6, 7 are pressed at least slightly against the inside edges 8, 9 of the wall opening 5 and the actuating wedge 14 as a result of its teeth 15 locks with the corresponding opposing teeth 16 of the first fixing element 6. The second action consists in that the actuating wedge 14 when pivoted into its mounting position is shifted between the elastic clamping element 10 and the terminal housing 3, by which the elastic clamping element 10 based on the wedge shape of the actuating wedge 14 is deflected away from the terminal housing 3 in the direction to the inside edge 11 of the narrow side of the wall opening 5, so that at least one of the ribs 13 of the clamping surface 12 interacts with the inside edge 11. The farther the actuating wedge 14 is pivoted in, the farther the clamping element 10 is deflected or pressed against the inside edge 11.

In FIGS. 1 and 2 one stop 17 is shown which is made on the terminal housing 3. The illustrated electrical terminal 1 is routed through the wall opening 5 until the stop 17 touches the housing wall 2, therefore striking it. The fixing element 6, 7 and the other clamping element 10 are made such that in the mounted state of the terminal 1 not only do they prevent motion of the terminal 1 in the plane of the housing wall 2, but also motion of the terminal 1 in the direction opposite the joining direction.

The electrical terminal 1 with the stop 17 formed on it is only one possible version of causing the desired clamping action in conjunction with the further elastic clamping element 10 of the mounting element 4; the stop 17 however in any case is not functionally critical to the teaching of the invention. In the other embodiment of a terminal in accordance with the invention which is however not shown here, the clamping surface of the fixing element 6, 7 and the clamping surface of the elastic clamping element 10 in the direction to the first inside edge 8, 9 and the other inside edge 11 are made as a depression bordered on both sides. Housing walls 2 of varied thickness penetrate to varied depths into the described depression in the installed state, the clamping surfaces formed in this way being able to prevent motion of the electrical terminal both in the joining direction and also opposite the joining direction. In another embodiment which likewise is not shown here, the stop and the mounting element in the mounting state of the electrical terminal are accessible from the side of the housing wall. Reference is made to German Patent Application DE 103 15 661 A1 and corresponding U.S. Patent Application Publication 2006/194,473 for the indicated configuration, especially to FIG. 2 which is shown in this document.

In the embodiment in FIGS. 1 & 2, the mounting element 4 is made separately from the terminal 1 and can be attached laterally on the terminal housing 3 by means of a catch, can be slipped into one pocket 18 which has been made on the two sides of the terminal housing 3, and can be locked there by means of a catch projection 19. The advantage of an execution of the mounting element 4 separate from the electrical terminal 1 is that the two parts can be produced separately from one another more easily than in a unit. On the other hand, it is then possible to replace a destroyed mounting element 4 by an intact mounting element 4 without having to immediately replace the entire electrical terminal 1. Finally there is still the advantage that the mounting element 4 can be mounted laterally on a terminal block which is formed from any number of disk-shaped terminals 1 which have been locked together.

In another embodiment of an electrical terminal 1 which is however not shown here, the terminal housing 3 is made in one piece with the mounting element 4.

In the embodiment shown in FIGS. 1 and 2, a symmetrical clamping action is achieved in that on two opposing sides of the terminal housing 3 there is one mounting element 4 at a time or one mounting element at a time is inserted into the two pockets 18. This prevents the terminal's 1 slipping or breaking out of the wall opening 5 on one side in or opposite the joining direction from being structurally preprogrammed when a tensile load is applied to the electrical terminal 1.

FIG. 3 shows one preferred embodiment of the mounting element 4 in accordance with the invention, as is also used in FIGS. 1 and 2 in conjunction with the terminal 1. The mounting element 4 is used to fix the electrical terminal 1 in one wall opening 5 of the housing wall 2. It has two fixing elements 6, 7 which in the mounted state of the terminal 1 act against one first inner edge 8, 9 of the wall opening 5 at a time or the stop 17 on the terminal housing 3. The mounting element 4 furthermore has an elastic clamping element 10 which is arranged essentially perpendicular to the two fixing elements 6, 7 such that the spring force of the clamping element 10 is pointed essentially perpendicular to the holding force of the fixing elements 6, 7. This simple construction makes it possible for the holding and clamping forces which can be applied by the fixing elements 6, 7 and the elastic clamping element 10 to be directed essentially perpendicular to one another. By using such a mounting element 4 together with an electrical terminal 1 it is consequently possible to jam the terminal 1 not only by means of the fixing elements 6, 7 with the opposing inside edges 8, 9 of the wall opening 5, but the electrical terminal 1 can be jammed essentially also with the inside edge 11 of the narrow side of the wall opening 5 in the housing wall 2.

The mounting element 4 which is shown in FIG. 3 has an essentially U-shaped base body with a U-back 20 and two U-legs 21, 22, and a catch tongue 23 which runs parallel to the base body. The ends of the two U-legs 21, 22 are each made as a fixing element 6, 7, and the elastic clamping element 10 is formed by the free end of the catch tongue 23 which is attached with its base area 24 in the region of the U-back 20. The free end of the catch tongue 23 is made as an oblique and slightly arched clamping surface 12 which points to the outside, on the clamping surface 12 there being several ribs 13 which run parallel to one another.

The preferred mounting element 4 shown in FIG. 3 is made such that it can be used especially well with an electrical terminal 1 which can be located in the wall opening 5 with a first inside edge 8, 9 and with the other inside edge 11 located essentially perpendicular on one another. For the generally rectangular wall openings 5 they are the lengthwise sides and the narrow sides which run perpendicularly to them. In this case, in the installed state of the electrical terminal 1 the two U-legs 21, 22 can be pressed flat against the first inside edges 8, 9 (=lengthwise sides) and the arched clamping surface 12 with its ribs 13 of the catch tongue 23 likewise flat against the other inside edge 11 (=narrow side) of the wall opening 5 in the housing wall 2.

The mounting element 4 as shown in FIG. 3 furthermore has an actuating wedge 14 which is located pivotally on the free end of the U-leg 22. The actuating wedge 14 can be pivoted into a position such that in the mounted state of the terminal 1 it presses the fixing elements 6, 7 and the elastic clamping element 10 against the corresponding inside edge 8, 9, 11 of the wall opening 5. The actuating wedge 14 thus performs the double function of deflecting both the two U-legs 21, 22 and also the catch tongue 23 so far that they are pressed tightly against the respective inside edge 8, 9, 11 of the wall opening 5 in the installed state of the electrical terminal 1 and fix the electrical terminal 1 reliably in the wall opening 5 of the housing wall 2 in this way.

The possibility of deflecting the two U-legs 21, 22 depends on whether the mounting element 4 is fixed laterally on the terminal housing 3 or is inserted into a corresponding pocket 18 on the terminal housing 3. If the mounting element 4 is inserted into the corresponding pocket 18 on the terminal housing 3, the U-legs 21, 22 can generally only be deflected to a very limited degree. The terminal 1 is then fixed essentially by the clamping element 10 which is pressed against the inside edge 11 of the narrow side of the wall opening 5.

So that the deflection of the U-legs 21, 22 and of the catch tongue 23 which is caused by the actuating wedge 23 is permanently ensured in the mounted state of the terminal 1, teeth 15 are formed on the surface of the actuating wedge 14 and on the side of the fixing element 6 facing the surface of the actuating wedge 14 corresponding opposing teeth 16 are formed which provide for locking of the actuating wedge 14 in the installed state of the terminal 1.

In the actuating wedge 14 there is a recess 25 into which an unlocking tool which is not shown, for example the blade of a screwdriver, can be inserted for the case in which the locking of the actuating wedge 14 is to be released with the U-leg 21 so that the electrical terminal 1 can be removed again from the wall opening 5 in the housing wall 2.

What is claimed is:

1. Electrical terminal for routing a line through a housing wall, comprising:

a rectangular terminal housing of insulating material, with at least one terminal connecting element; and a mounting element for fixing the terminal housing in a rectangular wall opening of the housing wall, the mounting element having at least one fixing element and an elastic clamping element which is located essentially perpendicular to the fixing element such when the terminal housing is mounted to the housing wall the clamping element acts against an inside edge of the narrow side of the wall opening;

wherein the mounting element has an actuating wedge which is pivotally located on the mounting element such that the actuating wedge can be pivoted into a position in which the elastic clamping element in the mounted state of the terminal is pressed by the actuating wedge against the corresponding inside edge of the wall opening, and wherein the actuating wedge can be fixed in this position.

2. Electrical terminal as claimed in claim 1, wherein the elastic clamping element has an arched or oblique clamping surface and the clamping surface has a plurality of ribs which run parallel to one another, wherein when the electrical terminal is mounted to the housing wall one of the plurality of ribs defines a tooth that interacts with the housing wall depending on the thickness of the housing wall.

3. Electrical terminal as claimed in claim 2, wherein the terminal housing is configured to be fixed in a wall opening of the housing having different wall thicknesses.

4. Electrical terminal as claimed in claim 1, wherein teeth are formed on a surface of the actuating wedge and on a side of the fixing element-facing the surface of the actuating wedge so that corresponding opposing teeth are formed.

5. Electrical terminal as claimed in claim 1, wherein the mounting element is laterally attachable to the terminal housing by a catch.

6. Electrical terminal as claimed in claim 1, wherein the terminal housing is made in one piece with the mounting element.

7. Electrical terminal as claimed in claim 1, wherein there is one mounting element on each of the two opposing sides of the terminal housing.

8. Electrical terminal as claimed in claim 1, wherein the at least one fixing element is a ledge for engaging an edge of the wall opening.

9. Electrical terminal as claimed in claim 1, wherein the clamping element flares outwardly with respect to the fixing element and is biased inwardly during mounting to the housing wall.

10. Mounting element for fixing an electrical terminal in a wall opening of a housing wall, comprising:

an essentially U-shaped base body, with a back and two legs extending from the back to form the U, and a catch tongue having a base area and a free end and which runs parallel to the base body, wherein the catch tongue with its base area is attached adjacent to the back so that the spring force of the clamping element is pointed essentially perpendicular to the lengthwise direction of the two legs, and wherein each of the ends of the two legs forms a fixing element for mounting the base body to the wall opening, and the free end of the catch tongue forms an elastic clamping element that adjustably mounts in the wall opening of the housing wall.

11. Mounting element as claimed in claim 10, wherein the ends of the legs each have a ledge that forms the fixing element.

12. Mounting element as claimed in claim 10, wherein the catch tongue is positioned between the legs of the U-shaped body.

13. Mounting element as claimed in claim 10, wherein the catch tongue is generally perpendicular to the legs.

14. Mounting element as claimed in claim 10, wherein a locking catch is formed on at least one of the legs for connection to a terminal housing.

15. Mounting element for fixing an electrical terminal in a wall opening of a housing wall, comprising:

an essentially U-shaped base body, with a back and two legs extending from the back to form the U, and a catch tongue having a base area and a free end and which runs parallel to the base body, wherein each of the ends of the two legs forms a fixing element for mounting the base body to the wall opening, and the free end of the catch tongue forms an elastic clamping element that adjustably mounts in the wall opening of the housing wall, wherein the catch tongue with its base area is attached adjacent to the back so that the spring force of the clamping element is pointed essentially perpendicular to the lengthwise direction of the two legs, and wherein an actuating wedge is pivotally located on the free end of one of the legs such that the actuating wedge can be pivoted into a position in which the elastic clamping element in the mounted state of the terminal is pressed by the actuating wedge against the corresponding inside edge of the wall opening.

16. Mounting element as claimed in claim 15, wherein teeth are formed on a surface of the actuating wedge and corresponding opposing teeth are formed on a side of the fixing element facing the surface of the actuating wedge.

17. Mounting element as claimed in claim 15, wherein a recess is formed in the actuating wedge for accommodating an unlocking tool.

18. Mounting element as claimed in claim 15, wherein the ends of the legs each have a ledge that forms the fixing element.

19. Mounting element as claimed in claim 15, wherein the catch tongue is positioned between the legs of the U-shaped body.

20. Mounting element as claimed in claim 15, wherein the catch tongue is generally perpendicular to the legs.

21. Mounting element as claimed in claim 15, wherein a locking catch is formed on at least one of the legs for connection to a terminal housing.

* * * * *